US006813989B2

(12) United States Patent
Santiyanont

(10) Patent No.: US 6,813,989 B2
(45) Date of Patent: Nov. 9, 2004

(54) ROTARY COMPRESSOR OR PUMP

(76) Inventor: Chanchai Santiyanont, 202/1 Moo 13 Krungthepkreetha Road, Sapansung, Bangkok 10250 (TH)

( * ) Notice: Subject to any disclaimer, the term of this patent is extended or adjusted under 35 U.S.C. 154(b) by 0 days.

(21) Appl. No.: 10/356,926

(22) Filed: Jan. 30, 2003

(65) Prior Publication Data

US 2003/0154936 A1 Aug. 21, 2003

Related U.S. Application Data

(63) Continuation-in-part of application No. 09/396,079, filed on Sep. 14, 1999, now Pat. No. 6,536,383.

(30) Foreign Application Priority Data

Sep. 18, 1998 (TH) ..... 046184

(51) Int. Cl.[7] ..... F01B 13/04
(52) U.S. Cl. ..... 91/491
(58) Field of Search ..... 91/491; 123/43 R, 123/43 B, 44 D

(56) References Cited

U.S. PATENT DOCUMENTS

| | | | | |
|---|---|---|---|---|
| 1,249,845 A | | 12/1917 | Soppitt | 123/44 D |
| 2,990,820 A | | 7/1961 | Saijo | 123/44 D |
| 4,077,365 A | | 3/1978 | Schlueter | 423/44 D |
| 4,106,443 A | | 8/1978 | Triulzi | 123/43 R |
| 4,166,438 A | | 9/1979 | Gottschalk | 123/44 D |
| 4,370,109 A | | 1/1983 | Sabet et al. | 418/34 |
| 4,421,073 A | | 12/1983 | Arregui et al. | 123/43 R |
| 5,123,394 A | | 6/1992 | Ogren | 123/44 D |
| 5,237,907 A | * | 8/1993 | Poschl | 91/491 |
| 5,967,102 A | | 10/1999 | Huang | 123/44 D |
| 6,062,175 A | | 5/2000 | Huang | 123/44 D |

FOREIGN PATENT DOCUMENTS

| | | |
|---|---|---|
| CH | 601657 | 12/1977 |
| DE | 329203 | 11/1920 |
| JP | 6429601 | 1/1989 |

* cited by examiner

*Primary Examiner*—Michael Koczo
(74) *Attorney, Agent, or Firm*—Ladas & Parry LLP

(57) ABSTRACT

A compressor having a fixed cylindrical casing, supporting a rotor having an externally driven input shaft extending rotatably and coaxially in the casing. The rotor includes piston chambers and reciprocable pistons in the piston chamber. A piston rod of each piston is connected to a crankshaft connected to the rotor for rotation therewith. The casing has fluid suction and discharge ports communicating with the piston chambers during rotation of the rotor to admit fluid through the suction port and discharge compressed fluid from the discharge port. A drive train synchronizes rotation of the crankshafts and the input shaft, a gear tooth ratio of an annular gear to pinion gears on the crankshafts is preferably twice the number of pistons in each rotor block.

7 Claims, 11 Drawing Sheets

B

ROTARY COMPRESSOR OR PUMP

This application is a C-I-P of application Ser. No. 09/396,079 filed Sep. 14, 1999, now U.S. Pat. No. 6,536,383.

FIELD OF THE INVENTION

The present invention relates generally to fluid machinery and, more specifically, to fluid pressurizing apparatus, such as a rotary compressor or pump of the type including a rotor supporting reciprocating pistons, around an axis of rotation.

DESCRIPTION OF THE PRIOR ART

In my earlier application Ser. No. 09/369,079 directed to a rotary internal combustion engine, alternative embodiments envision the use of the invention as a compressor or as a pump. The compressor or pump has the same structure as that of the rotary internal combustion engine including a cylindrical casing, a rotor with an input shaft as its axis, in the cylindrical casing and crankshafts, pistons and piston chambers within the rotor. Each piston chamber undergoes expansion by a downward movement of the piston to draw fluid such as air through a filter connected to a suction port on the outer casing. After compression, the fluid is driven out of the discharge port to a storage tank for further use.

When driven by a motor as a prime mover, the compressor or pump is used to compress a gas or pressurize a liquid. When working as a compressor or pump, the reciprocating pistons will operate on a two-stroke cycle, completing each cycle for one revolution of the piston chamber.

SUMMARY OF THE INVENTION

In accordance with the invention, the fluid pressurizing apparatus comprises a casing defining a cylindrical chamber; a rotor having an input shaft in the cylindrical chamber, piston chambers and pistons in the rotor, crankshafts with pinion gears connected to the pistons and a drive train to synchronize rotation of the input shaft and the crankshafts.

BRIEF DESCRIPTION OF THE DRAWINGS

FIGS. 13D–13F illustrate the concurrent discharge stroke of the piston in the second block of the fluid pressurizing device, FIGS. 13G, 13H illustrate the discharge stroke of the piston in the first A block of the fluid pressure device, FIGS. 131 and 13J illustrate the concurrent suction stroke of the piston in the second block of the fluid pressurizing device.

DETAILED DESCRIPTION

Figure 1A:
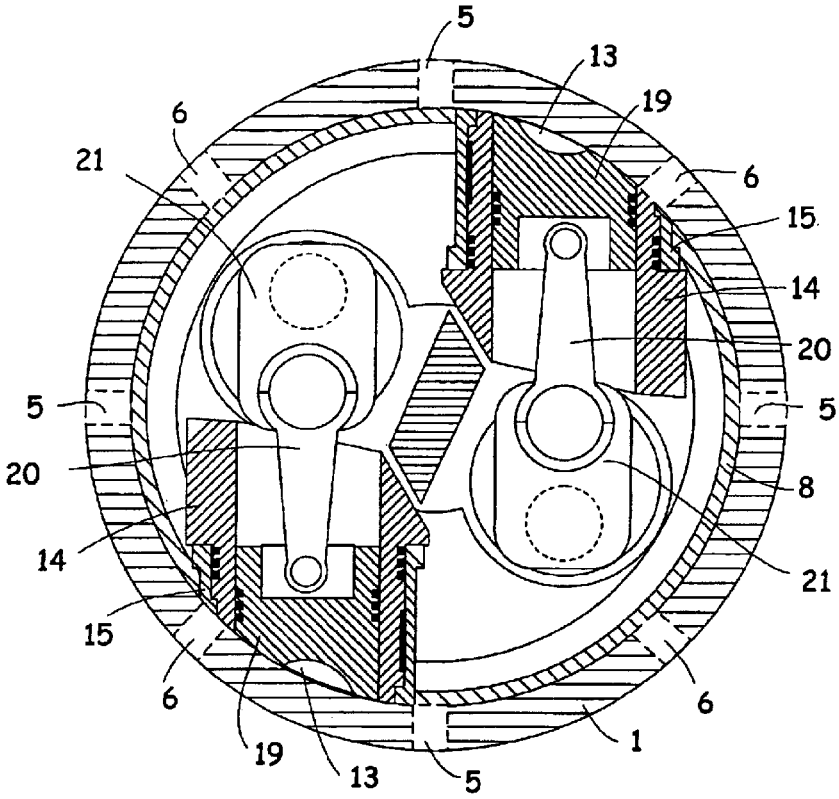
FIGS. 1A and 1B are respective sectional views through first and second blocks of a fluid pressurizing device according to the invention.
Figure 1B:
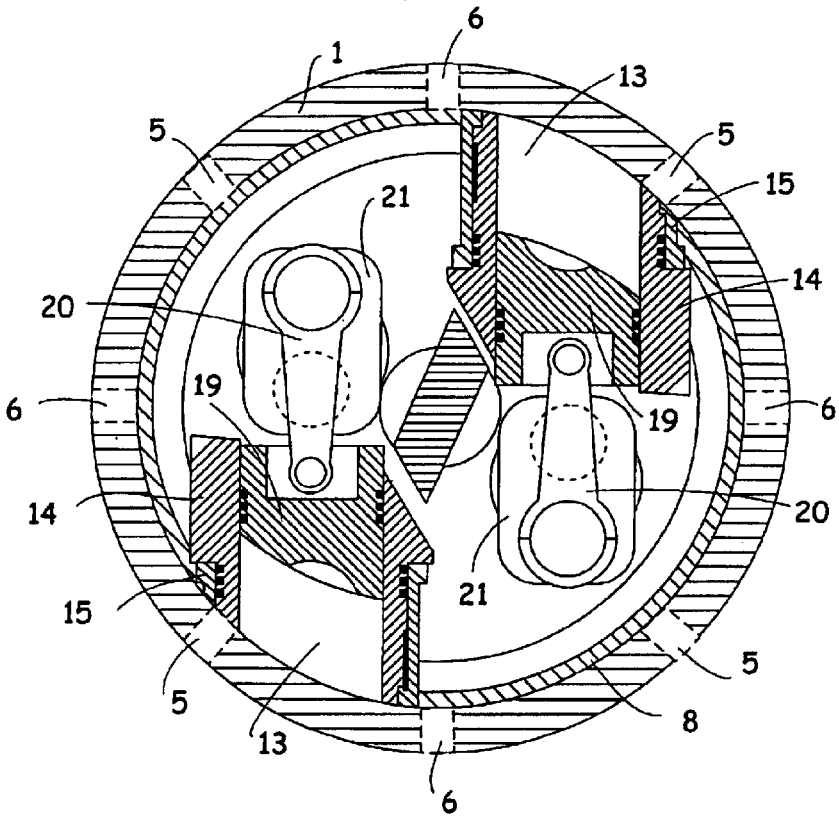
Figure 2:
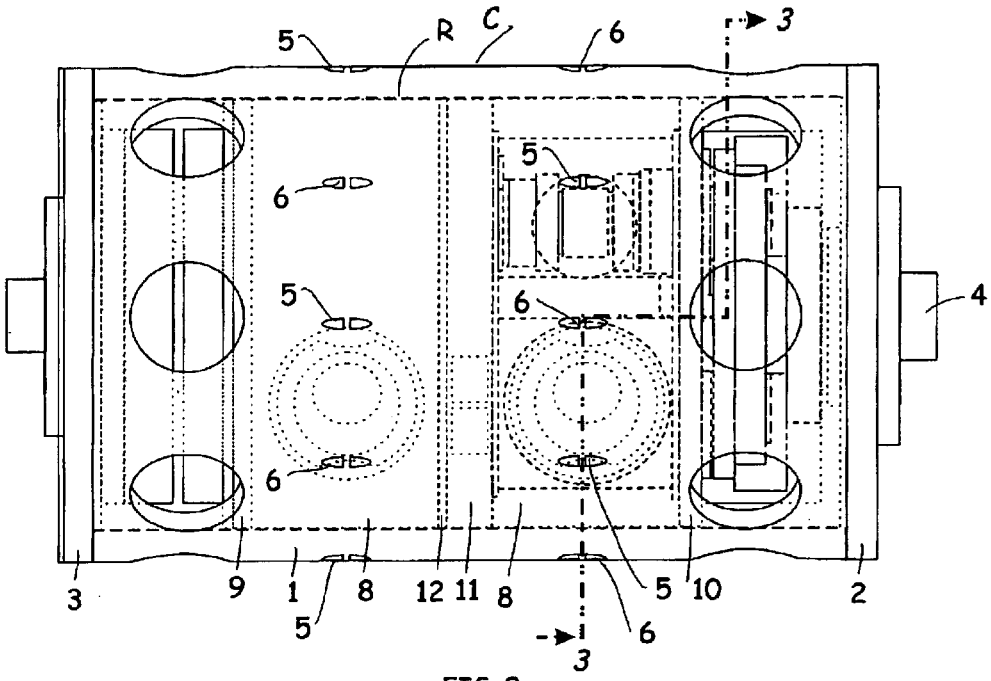
FIG. 2 is a top plan view of the fluid pressurizing device.

Referring to FIG. 2, therein is seen a fluid pressurizing device according to the invention. When the device operates with a compressible gas, it functions as a compressor whereas when it operates with a liquid, it functions as a pump.

The invention will be described hereafter in its operation as a compressor and it will be obvious to those skilled in the art that the same operation is carried out when it operates as a pump.

In FIG. 2, there is seen a fixed casing C of the compressor formed by an outer cylinder 1 and a pair of end plates 2, 3. A cylindrical rotor R is supported in the casing for rotation in outer cylinder 1. Discharge ports 5 and suction ports 6 are provided in the outer cylinder 1 to provide communication with piston chambers 13 in rotor R as will be described later.

The cylindrical rotor R includes two annular blocks or bodies 8, 8 each having a cylindrical outer surface matching the cylindrical inner surface of outer cylinder 1. The rotor R has an input shaft 4 which is driven around an axis of rotation of the shaft by an electric motor (not shown) as a prime mover. Alternatively, the device can be used as a fluid motor to deliver output drive to shaft 4 when pressurized fluid is input to the device at suction port 6.

Figure 7:
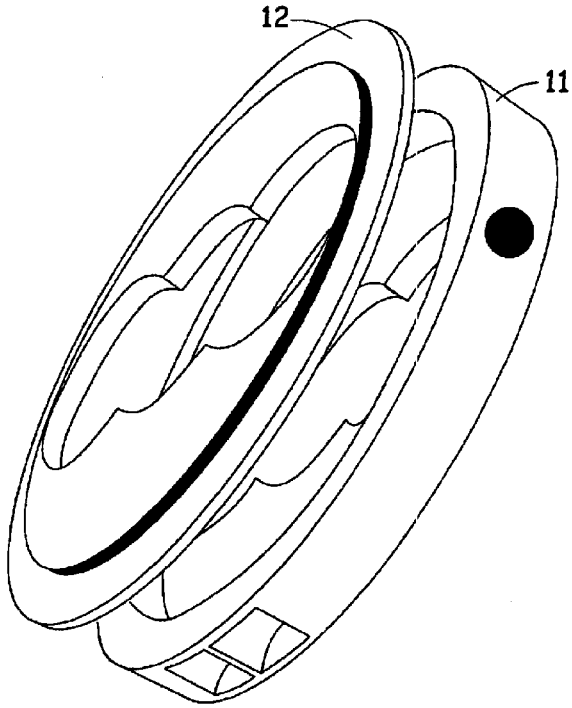

The rotor R includes crankshafts 21 driven by the pistons, a front crankshaft mounting plate 9, and its cover 9', and a rear crankshaft mounting plate 10. The mounting plates 9 and 10 are secured to the annular bodies 8. Between the two annular bodies 8 of the rotor is a crankshaft middle mounting plate 11 and its cover 12 (a detail of plate 11 and its cover 12 is shown in FIG. 7). The input shaft 4 extends through the casing and is rotatably mounted in the casing by sleeve bearings in the end plates 2, 3 of the casing.

The axis of input shaft 4 is coincident with the axis of rotation of rotor R and the input shaft and the rotor rotate together.

Figure 8:
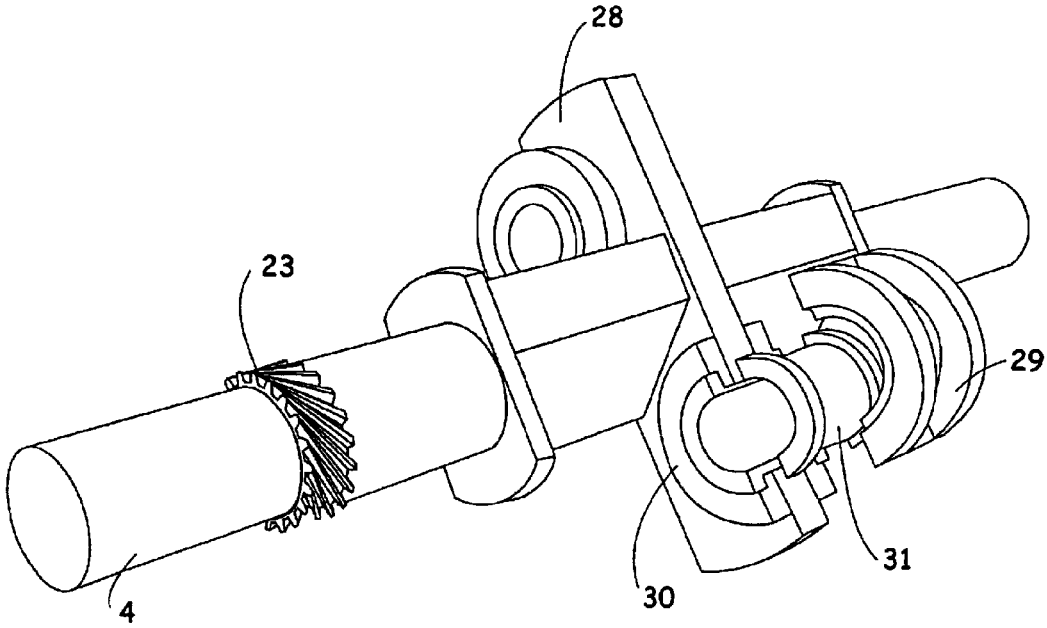

As shown in FIG. 8, a crankshaft-mounting arm 28 is fixedly secured on the input shaft 4 for bodily rotation therewith. The crankshaft-mounting arm 28 includes a bearing support for each crankshaft 21 which includes a bearing housing 29, 30 and a bearing 31 in the housing for rotatably supporting the respective crankshaft 21.

Figure 6:
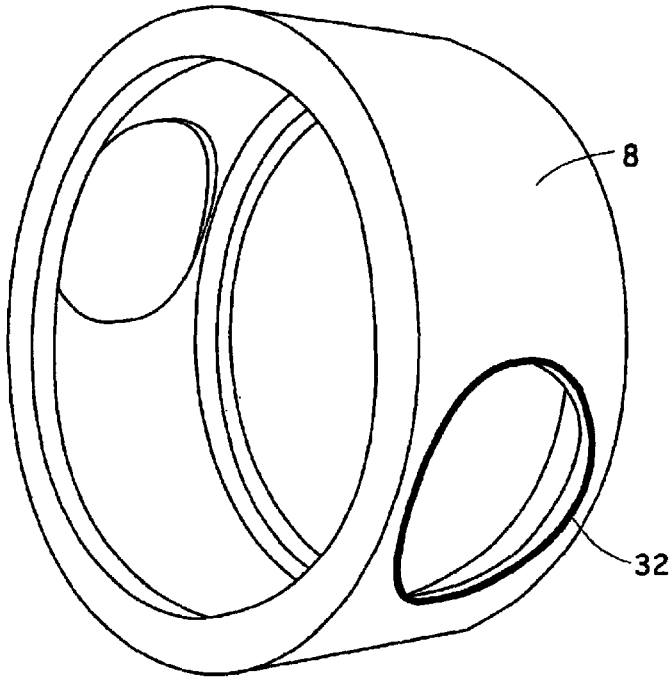
FIG. 6 is a perspective view of an annular body of the casing of the FIG. 7 is a perspective view of a crankshaft middle mounting plate of the FIG. 8 is a perspective view of the input shaft and a crankshaft mounting arm of the device.

Piston chambers 13 are fixedly secured by piston chamber bases 14 inside each annular body 8 of rotor R. Each piston chamber extends along an axis spaced radially from the axis of rotation of the rotor and perpendicular to a plane passing through the axis of rotation. The piston chambers 13 are enclosed in a cylindrically shaped valve casing 15. In FIG. 6, is seen a seal 32 inserted in rotor annular body 8 to engage valve casing 15 to prevent oil leakage from the valve casing 15.

The axes of the piston chambers are preferably uniformly spaced from the axis of rotation of input shaft 4 in the direction of rotor rotation.

The cylindrical shape valve casing 15 is slightly movable along the axis of its respective piston chamber 13.

Figure 9:
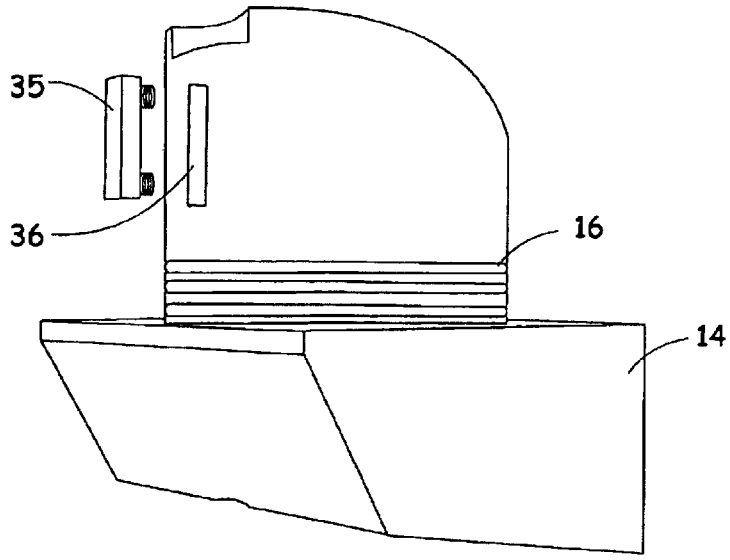
FIG. 9 is an exploded perspective view of a piston chamber base and cylindrical shape valve of the device.
Figure 9A:
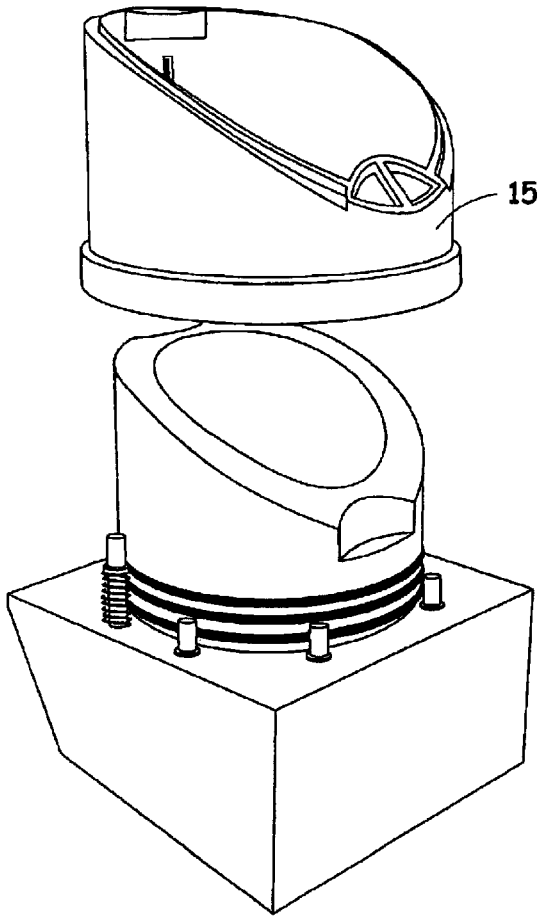
FIG. 9A is a perspective view from the side and back of the piston chamber base and cylindrical shape valve.
Figure 9B:
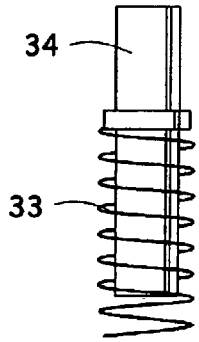
FIG. 9B is an enlarged view of a detail of a connection spring stem and coil spring valve of the piston chamber.

A curved end of the valve casing 15 is pressed against the inner cylindrical surface of the outer cylinder 1 of the casing by coil springs 33 to be sealed and fluid-tight thereat. As shown in FIG. 9B, the coil springs 33 are seated on respective spring stems 34 mounted on piston chamber base 14 and the lower end of cylindrical shape valve casing 15 to resiliently resist movement of the casing 15 with respect to piston chamber base 14. At the outer surface of piston chamber base 14 a ring-seal 16 is provided to prevent leakage from cylindrical valve casing 15. A spring-loaded key 35 is mounted in keyways 36, 37 in each piston chamber and in its cylindrical shape valve casing 15 respectively.

Figure 10A:
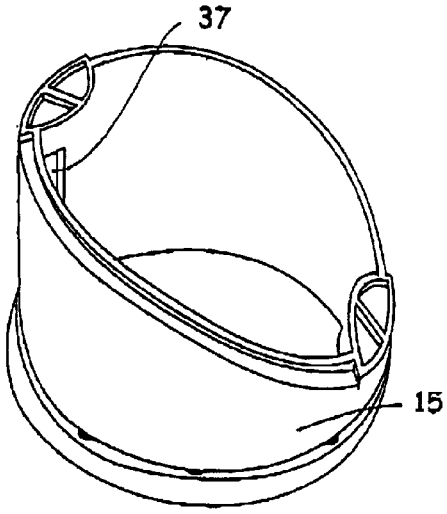
FIG. 10A is a perspective view showing interior details of the cylindrical shape valve of the piston chamber.
Figure 10B:
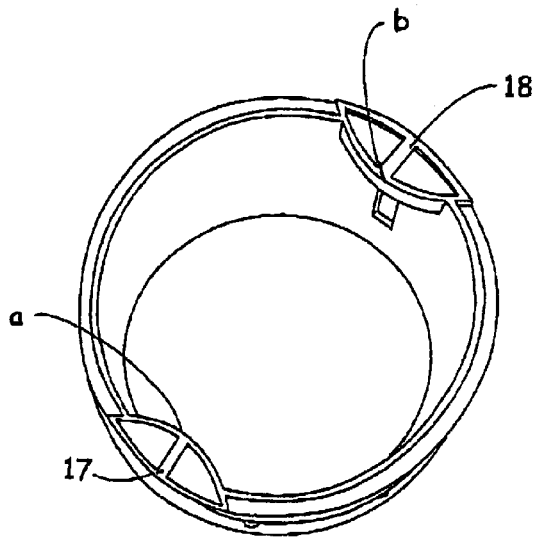
FIG. 10B is another view from a different perspective of the valve of FIG. 10A.
Figure 10C:
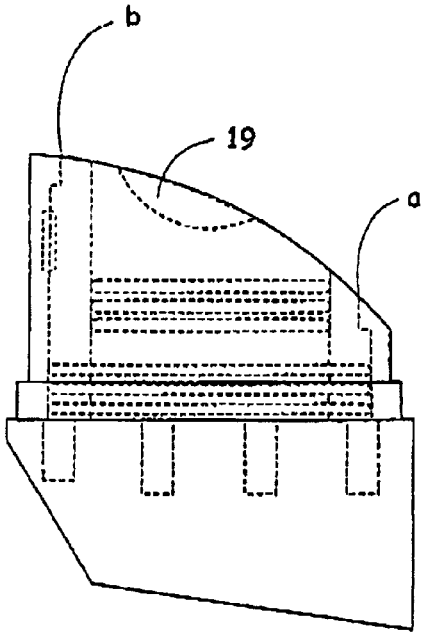
FIG. 10C is a side view of FIG. 9.

As shown in FIG. 10B, an opening valve 17 and a closing valve 18 are formed in the curved surface of cylindrical shape valve casing 15. Opening valve 17 determines the opening position of the discharge port and the suction port, and closing valve 18 determines the closing position of the discharge port and the suction port. Each valve has a cylindrical shaped end corresponding to the shape of the cylindrical casing so as to close the ports when the valve member is closed.

A piston 19 of cylindrical shape undergoes reciprocal movement in each piston chamber 13. A piston rod 20 is pivotally connected to each piston 19 and is rotatably connected by a corresponding crank to crankshaft 21.

The two annular blocks 8,8 of the fluid pressurizing device, each includes two pistons 19. The first block, and its piston chamber bases 14, are fixedly secured to the front mounting plate 9 of the crankshafts and the middle mounting plate cover 12. The second block and its piston chamber bases 14 are fixedly secured to rear mounting plate 10 of the crankshafts and to the middle mounting plate 11.

Figure 11A:
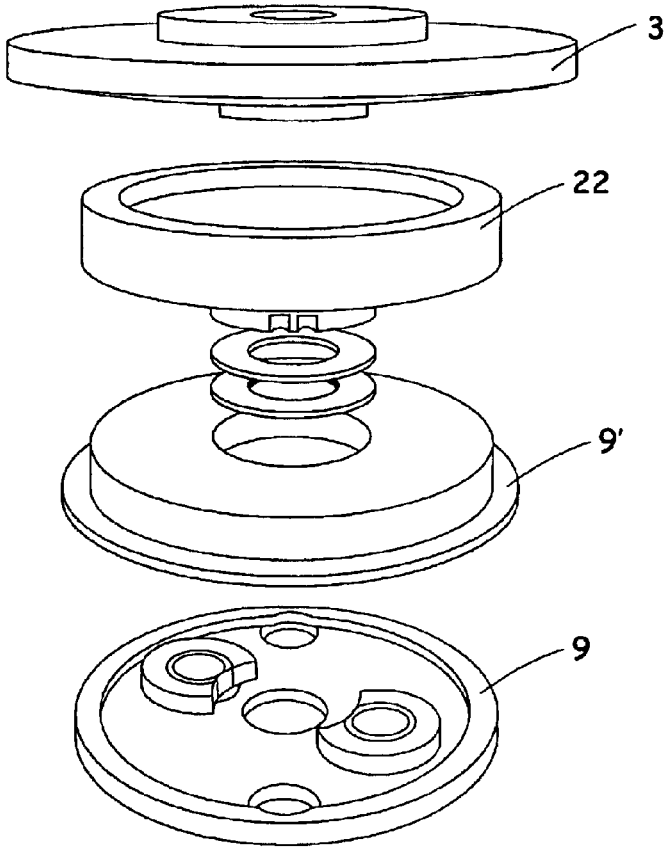
FIG. 11A is an exploded view of FIG. 11.
Figure 11:
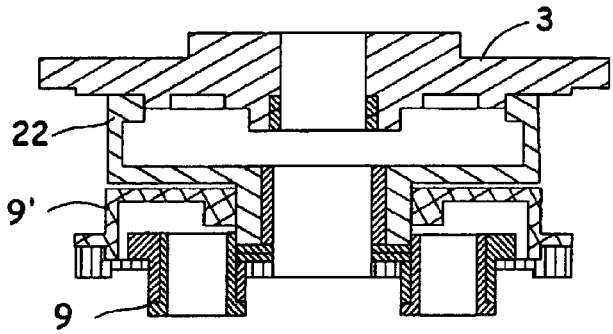
FIG. 11 is a sectional view through a front end of the casing of the device.

FIG. 11 illustrates a gear chamber 22 between front end plate 3 and cover 9'. Gear chamber 22 contains a fixed gear 23 (FIG. 8) formed at the front end of input shaft 4 for driving a lube oil pump (not shown).

Figure 3:
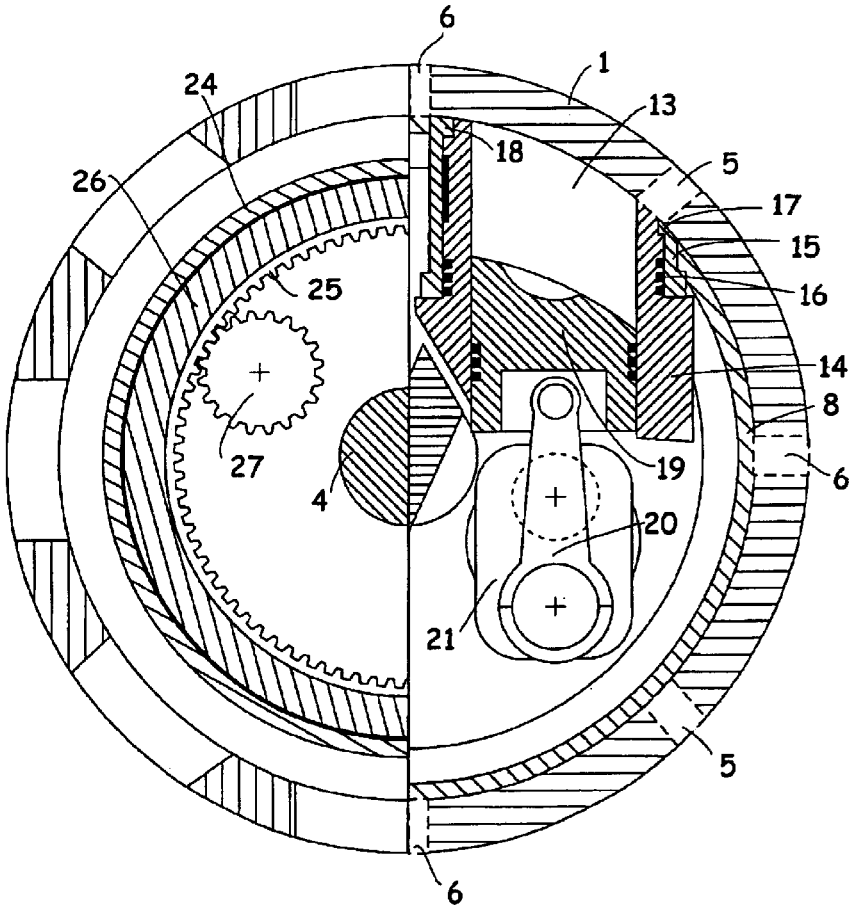
FIG. 3 is a sectional view taken along line 3—3 in FIG. 2.
Figure 4:
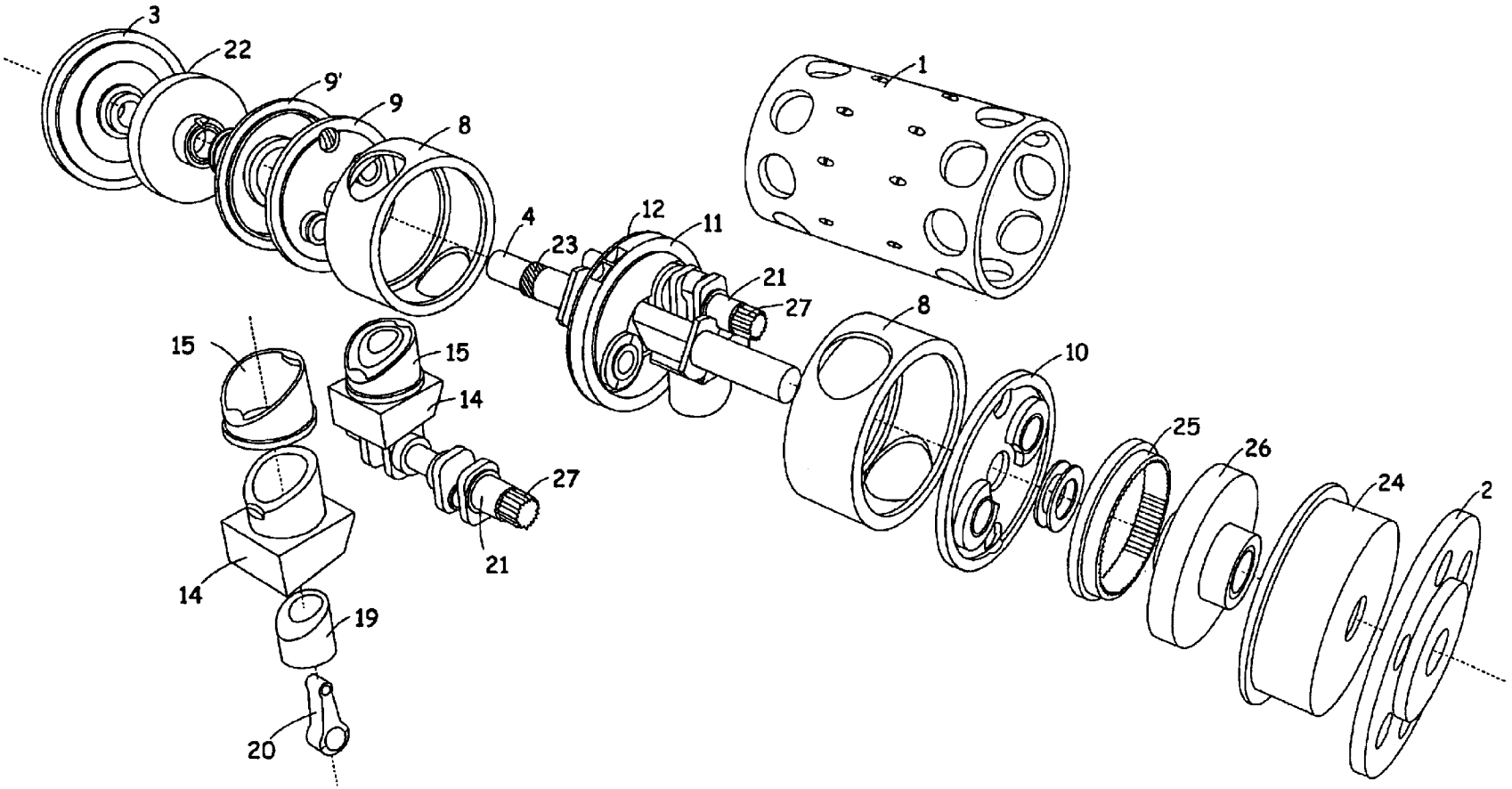
FIG. 4 is a perspective exploded view of the fluid pressurizing device.
Figure 5:
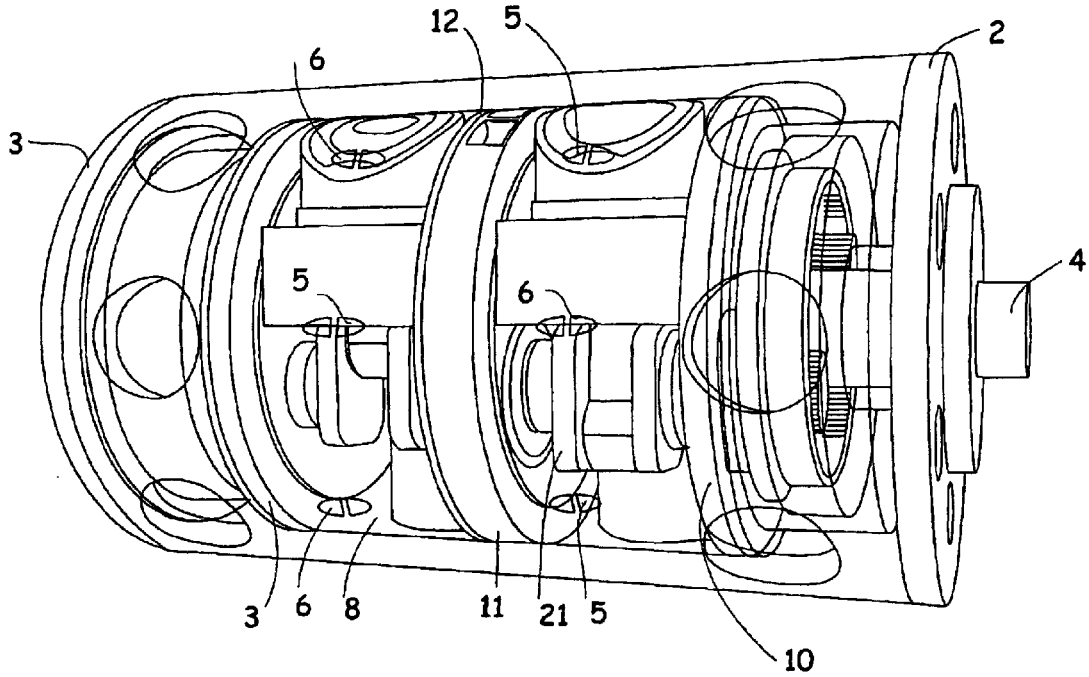
FIG. 5 is a perspective view of the assembled device.
Figure 12A:
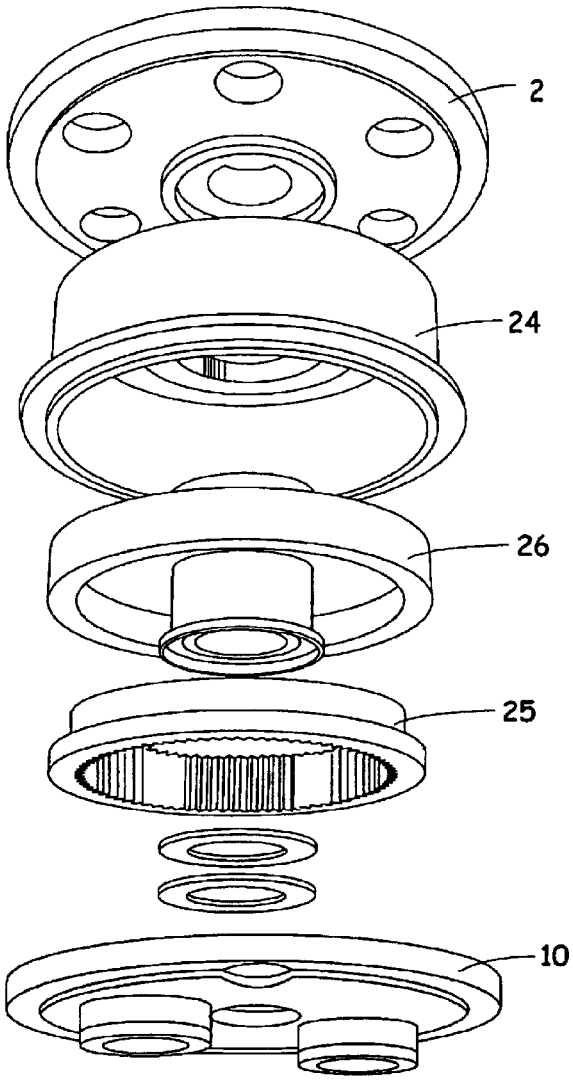
FIG. 12A is an exploded view of FIG. 12, FIGS. 13A–13C diagrammatically illustrate the suction stroke of the first block of the fluid pressurizing device.
Figure 12:
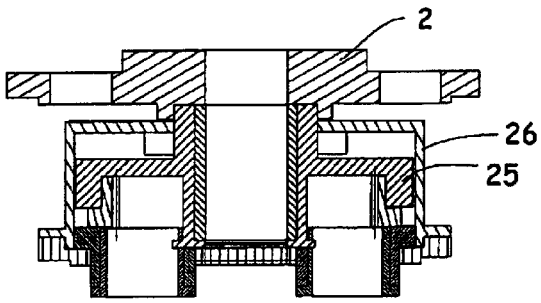
FIG. 12 is a sectional view of a rear end of the casing of the device.

A drive train is provided to synchronize the rotation of the input shaft 4 and both of the crankshafts 21. As shown in FIG. 12A, the drive train includes an annular gear-carrying cap 26 in a drive train chamber 24 disposed between rear end plate 2 of the casing and rear mounting plate 10 of the crankshafts. A sleeve which supports the input shaft is formed at the center of annular gear-carrying cap 26 with one end of the sleeve fixedly secured to rear end plate 2 of the casing. An annular gear 25 is fixed to the annular gear-carrying cap 26. The annular gear 25 meshes with pinion gears 27 (FIGS. 3 and 4) formed on the rear ends of both crankshafts 21. The drive train provides a ratio of the gear teeth of the annular gear to the pinion gears appropriate to efficiency of the fluid pressurization. Advantageously, the gear ratio is equal to twice the number of pistons in each body 8. For example, in a typical two-piston device, the gear tooth ratio of the annular gear to the pinion gears is 4:1 so that when the input shaft rotates one revolution clockwise, the crankshafts will rotate four revolutions (2 cycles). Similarly, the gear tooth ratio can be any whole number equal to 3, 4, 6 or 8 in which case the crankshaft rotation for each revolution of the input shaft will be 6:1, 8:1, 12:1 and 16:1 respectively.

As the input shaft 4 and crankshafts 21 concurrently rotate, the pistons 19 reciprocate in their piston chambers due to the rotation of crankshafts 21. The reciprocation of the pistons is synchronized to achieve suction and discharge of pressurized fluid.

Figure 13:
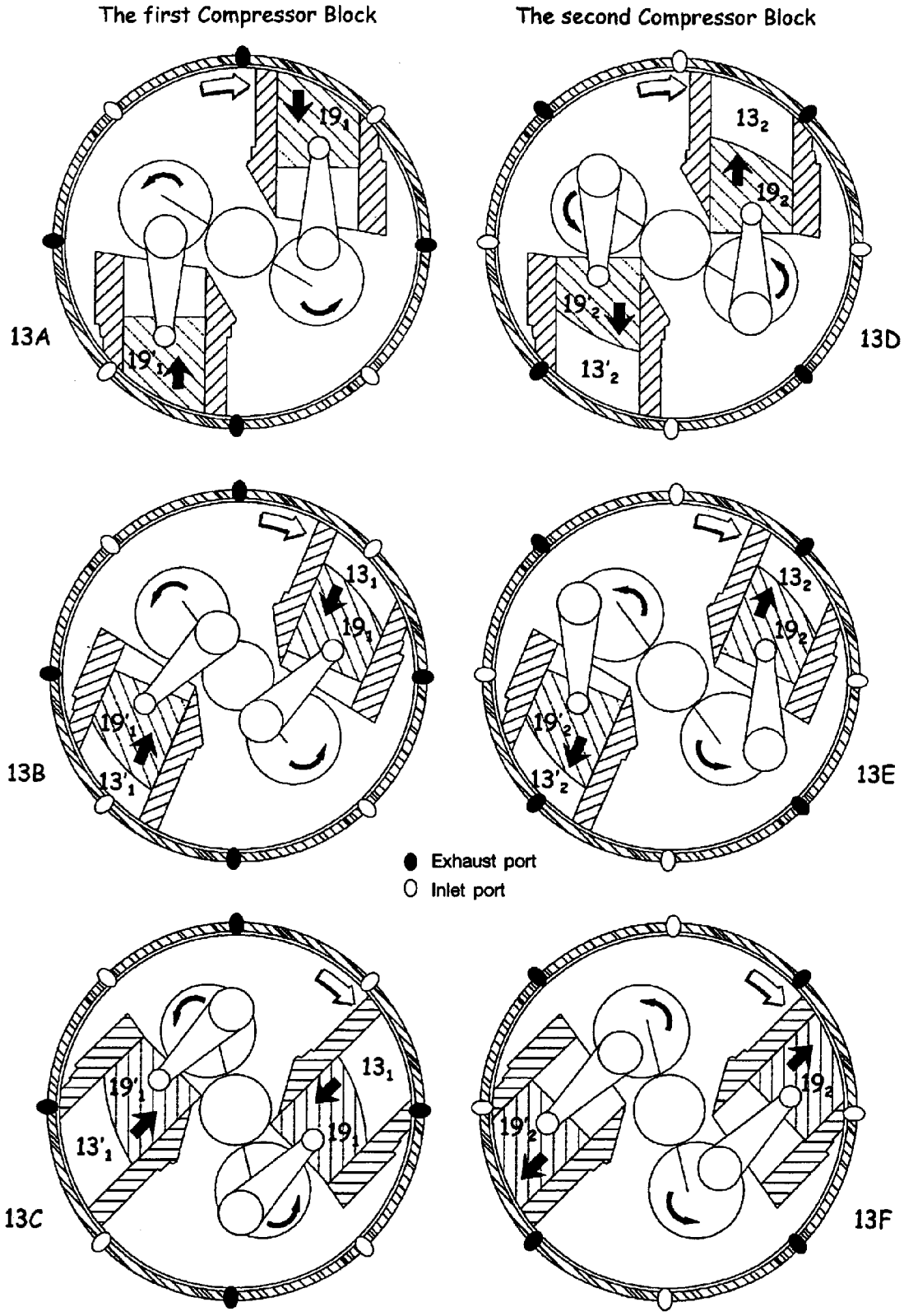
Figure 13:
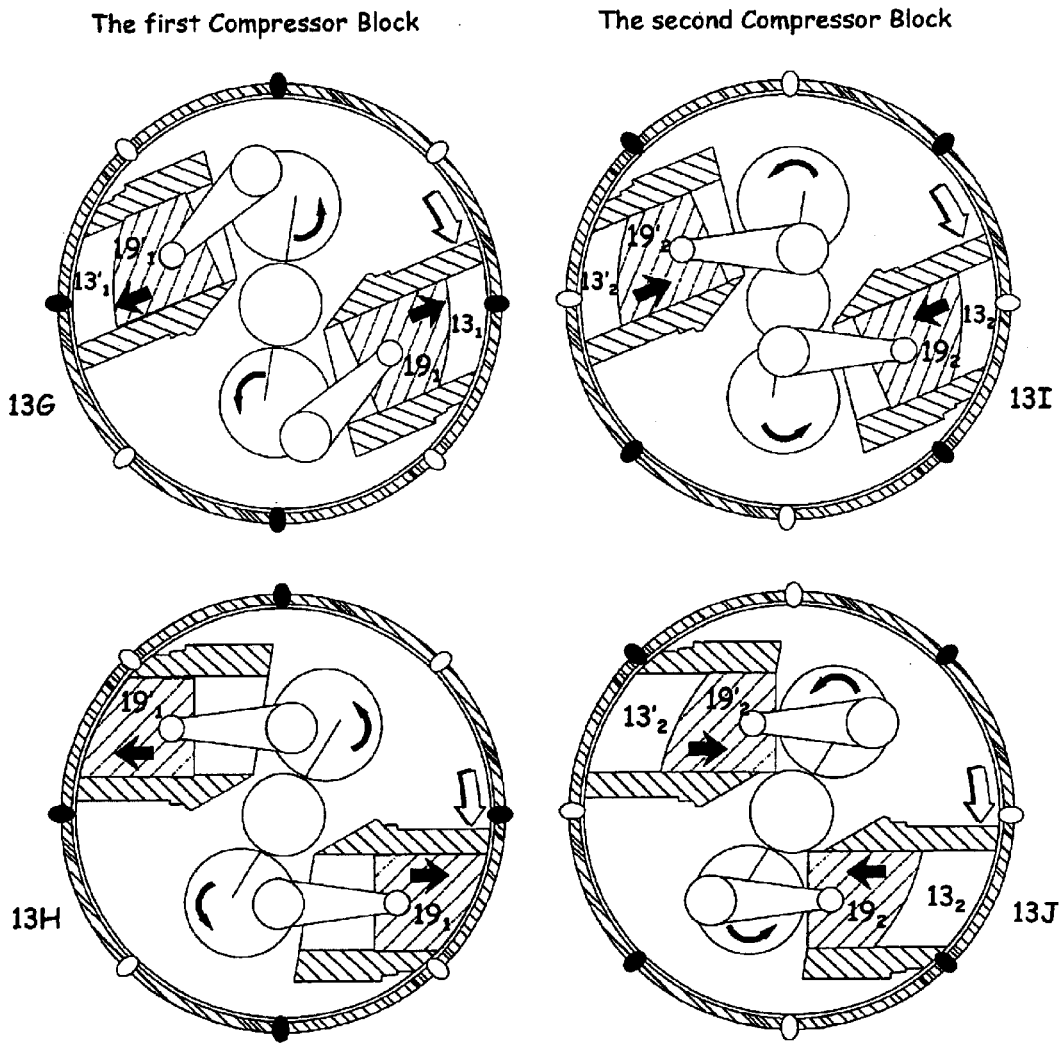

As an example, the operation sequence of the device as a compressor is shown in FIGS. 13 and 14 which illustrate two pistons in each block 8.

During the suction stroke in the first piston chamber (FIGS. 13A, B, C), the piston chambers pass the suction port while the piston moves downwards accordingly to suck the fluid into its piston chamber. When the piston completes its downward travel, the suction stroke is completed. At the same time the second body is operated in the discharge stroke (FIGS. 14D, E, F).

The discharge stroke of the first body (FIGS. 14G, H) occurs when the piston chambers continue moving around the axis of rotation of the input shaft while the crankshafts drive the pistons to move upwards to apply pressure to the fluid. At the same time the second compressor block is operating in the suction stroke (FIGS. 14I, J).

The movement of each pair of pistons must be balanced in order to minimize input power losses. Depending on the size and on the magnitude of compression of the fluid, the compressor may include more than two rotor bodies. Each compressor body comprises a plurality of pistons and piston chambers, preferably two or more with the same requirement for balancing. Moreover, the number of compression strokes of each piston will be substantially twice the number of pistons in each rotor body i.e. six, eight, twelve and sixteen strokes for 3, 4, 6 and 8 pistons.

The essential features of the invention have been described above but it will be possible to modify certain details of the manufacturing process within the scope of the invention as defined by the attached claims.

What is claimed is:

1. A fluid pressurizing device comprising:

a fixed cylindrical casing, a rotor in said casing, said rotor having an externally driven input shaft extending rotatably and coaxially in said casing, said rotor including a plurality of piston chambers and respective pistons in said piston chambers, said pistons being reciprocable in said chambers along axes spaced radially from an axis of rotation of said input shaft and said pistons each having a piston rod connected to a crankshaft connected to said rotor for rotation therewith, said casing having fluid suction and discharge ports communicating sequentially with said piston chambers during rotation of said rotor to admit fluid through said suction ports and discharge pressurized fluid from said discharge ports, each said piston chamber being enclosed by a valve casing which has a curved end which is pressed against and matches an inner surface of said cylindrical casing, valves on each said valve casing to provide respective communication between said suction and discharge ports and the respective said piston chamber, and a drive train synchronizing rotation of said crankshafts and said input shaft, said drive train comprising a fixed annular gear secured to said casing and pinion gears on said crankshafts in mesh with said fixed annular gear, said pistons undergoing reciprocal movement in said piston chambers in synchronism in which the pistons have the same stroke position in said chambers, end said annular gear and said pinions having a tooth ratio equal to twice the number of pistons.

2. The fluid pressurizing device of claim 1, wherein said rotor includes a plurality of blocks each including a plurality of said pistons and piston chambers.

3. The fluid pressurizing device of claim 2, wherein said piston chambers and said pistons are arranged in said blocks in pairs in opposition to one another.

4. The fluid pressurizing device of claim 1, comprising a crank arm connected to said rotor, said piston rods being connected to respective ends of said crank arm.

5. The fluid pressurizing device of claim 2, wherein each said block includes a mounting plate rotatably supporting one end of the crankshafts of the pistons in said block, and a middle mounting plate disposed between adjacent blocks to rotatably support opposite ends of the crankshafts of the pistons in the adjacent blocks.

6. The fluid pressurizing device of claim 5, wherein said valve casings are secured to said mounting plates.

7. The fluid pressurizing device of claim 1, wherein each piston has a curved end corresponding in shape to the cylindrical casing.

* * * * *